US006056158A

United States Patent [19]

Rossetti et al.

[11] Patent Number: 6,056,158

[45] Date of Patent: May 2, 2000

[54] SYSTEM FOR THE PRESERVATION, TRANSPORTATION AND DISPENSING OF DYES, AS WELL AS A DISPENSING MACHINE PARTICULARLY SUITABLE FOR USE IN THE SYSTEM

[75] Inventors: Edoardo Rossetti, Finale Emilia; Umberto Marazzi, Medolla, both of Italy

[73] Assignee: COROB S.p.A., Modena, Italy

[21] Appl. No.: 08/805,054

[22] Filed: Feb. 24, 1997

[30] Foreign Application Priority Data

Mar. 27, 1996 [IT] Italy ..... MI96A000600

[51] Int. Cl.[7] ..... B65D 35/28

[52] U.S. Cl. ..... 222/95; 222/96; 222/98; 222/100; 222/101; 222/102; 222/105; 222/107

[58] Field of Search ..... 222/1, 95, 96, 222/98, 100, 101, 102, 105, 107; 141/104, 114

[56] References Cited

U.S. PATENT DOCUMENTS

| | | | |
|---|---|---|---|
| 3,151,616 | 10/1964 | Selfon | 128/214 |
| 4,539,005 | 9/1985 | Greeblatt | 222/95 |
| 4,925,444 | 5/1990 | Orkin et al. | 604/80 |
| 5,248,300 | 9/1993 | Bryant et al. | 222/95 |
| 5,310,085 | 5/1994 | Lontrade et al. | 222/1 |
| 5,358,142 | 10/1994 | Holmes | 222/1 |
| 5,673,818 | 10/1997 | Kaneski et al. | 222/105 |
| 5,697,407 | 12/1997 | Lasonde | 141/104 |

FOREIGN PATENT DOCUMENTS

| | | |
|---|---|---|
| 0190757 | 8/1986 | European Pat. Off. . |
| 0198856 | 10/1986 | European Pat. Off. . |
| 2388733 | 11/1978 | France . |
| 1965155 | 7/1970 | Germany . |
| 2146705 | 4/1985 | United Kingdom . |
| WO910615 | 7/1991 | WIPO . |
| WO9119651 | 12/1991 | WIPO . |
| WO7900092 | 3/1997 | WIPO . |

*Primary Examiner*—Steven O. Douglas
*Assistant Examiner*—Timothy L. Maust
*Attorney, Agent, or Firm*—Sughrue, Mion, Zinn, Macpeak & Seas, PLLC

[57] ABSTRACT

A system for the preservation, transportation and dispensing of dyes provides for a combination of a hollow reservoir having at least one deformable wall so that its internal volume can vary from a maximum to a minimum substantially close to zero, and an opening for the connection of the reservoir to a dye-dispensing circuit; the reservoir is airtight so that its internal volume corresponds to the volume of dye contained therein in essentially any condition of use.

1 Claim, 1 Drawing Sheet

SYSTEM FOR THE PRESERVATION, TRANSPORTATION AND DISPENSING OF DYES, AS WELL AS A DISPENSING MACHINE PARTICULARLY SUITABLE FOR USE IN THE SYSTEM

BACKGROUND OF THE INVENTION

The present invention relates to a system for the preservation, transportation and dispensing of dyes. The invention also relates to a reservoir and to a dispensing machine particularly suitable for use in the system.

In the field of varnish-, paint-, and ink-production and the like, the use of dispensing machines which provide for the coloring of a neutral, for example, white or transparent, base by the dispensing and mixing of the base with small predetermined quantities of dyes is now very widespread. The dyes are normally stored in reservoirs which are generally mounted in dispensing machines of known type, for example, such as that described in the Applicant's patent EP-0 198 856.

The continuous development of dispensing machines and the developments in the colored-paint production field as a whole, as well as increased user requirements, have brought to light problems with known production systems.

In particular, the filling, refilling or topping-off of the dye reservoirs are particularly lengthy, impractical and wasteful operations in terms of time and wastage of dye. The refill of dye is normally kept, transported and supplied in containers, for example, tins or bottles, the contents of which have to be decanted into reservoirs mounted in the dispensing machines. Upon completion of this operation, which is carried out manually, it can be seen that a certain quantity of dye remains adhered to the internal walls of the containers used for refilling and is thrown away together with the containers. Moreover, during dye-decanting operations, it is often necessary to use auxiliary filling means such as, for example, funnels and the like, to the walls of which a certain quantity of dye remains stuck, this quantity also being unusable and being thrown away upon completion of the topping-off or refilling operations.

The filling of the reservoirs also causes the dyes to be mulsified with air, necessitating the provision of homogenization systems, for example, such as mechanical stirrers, which are mounted inside the reservoirs and have to remain active for quite a long time to allow the air contained in the dye to be expelled. Until this homogenization operation is completed, the dye cannot be dispensed since the presence of air in emulsion modifies its physical properties of volume and specific weight, making accurate dispensing difficult.

Increasing sensitivity to problems of pollution and waste disposal, which is often reflected in very rigorous norms, also makes the treatment of waste products, whether they are containers or dyes, increasingly onerous. The costs of transportation, storage and the disposal of waste products are gradually assuming proportions which are difficult to reconcile with the requirement to produce low-cost paint products for mass consumption.

A further disadvantage of known systems is that, when the quantity of dye in the reservoirs decreases, the film of dye which remains adhered to the internal walls of the reservoirs dries upon contact with air, forming a solid film which tends to break up. The solid particles thus formed mix with the dye, causing a series of quite serious problems ranging from partial obstruction of the ducts of the dispensing machine to contamination of the finished paint product, with obvious disastrous consequences from the point of view of dispensing accuracy and of the quality of the finished colored product. Moreover, if periodic complete cleaning of the ducts of a dispensing machine is not impossible, it is certainly very onerous in terms of cost and unproductive time when the machine is stopped.

The problem of drying inside the reservoirs is noticed particularly and assumes considerable proportions especially with the use of so-called "solvent-free" dyes, the vector fluid of which has a marked tendency to evaporate on contact with air, with consequent precipitation and/or thickening of the pigment. In these cases, the known solutions provide for the use of expensive and complex sealing systems, stirring and recirculation of the dye, which are detrimental to the economical production and use of the machines.

Various solutions have been proposed for solving the problems mentioned above, but none has succeeded in providing a wholly satisfactory and economical solution. The object of the present invention is to solve all of the problems mentioned above simply, cheaply and effectively.

SUMMARY OF THE INVENTION

In order to achieve this object, the subject of the invention is a system for the preservation, transportation and dispensing of dyes, characterized in that it comprises, in combination, a hollow reservoir having at least one deformable wall so that its internal volume can vary from a maximum to a minimum substantially close to zero, and an opening for the connection of the reservoir to a dye-dispensing circuit, the reservoir being air tight so that its internal volume corresponds to the volume of dye contained therein, essentially in any condition of use.

A further object of the invention involves the provision of a dispensing machine and a reservoir particularly suitable for use in a system formed according to the principles of the present invention.

An important advantage of the present invention is that, in practice, the dye never comes into contact with air until it is dispensed into the final container which is to hold the finished colored product. Evaporation of the vehicle of the dye and consequent thickening or precipitation of the pigment are thus prevented. The time required to put the machine into operation after refilling is also reduced since it is no longer necessary to homogenize the dye. Systems for homogenizing the dye are also eliminated, with clear advantages in terms of the simplicity and cheapness of the construction of the dispensing machines.

Another advantage is a reduction in replenishment times and in the related costs. Moreover, it is no longer necessary to rely upon the manual dexterity of an operator in order to decant the dye by hand. The maximum quantity of dye is usable, with clear economic advantages, given that waste disposal is also less onerous.

Once the basic principle of the invention is known, a person skilled in the art can easily identify alternative embodiments of the deformable reservoir. For example, it is possible to produce reservoirs having at least one folding wall, for example, cylindrical bodies which can be folded up like a bellows or a concertina, as well as flexible bags, so that the change in the internal volume of the reservoirs takes place by virtue of a change in their geometry. Alternatively, reservoirs may be made of resilient material so that the change in internal volume is determined wholly or partially by a change in the area of at least one wall of the reservoir.

A preferred embodiment of the invention consists of a flexible bag of material impermeable to air, comprising a dispensing nozzle disposed in the lower portion of the bag. The upper portion of the bag comprises suspension means such as eyes, hooks, rods or other similar means which can be used effectively for the storage and transportation of the bag and for supporting it inside the dispensing machine.

The flexible reservoir may be transparent so that it is easy to check the type and quantity of dye contained therein, but may also be made of opaque material when it is preferable to prevent exposure of the dye to light.

The flexible reservoirs may be used once only and, in that case, the fact that they can be folded up and compressed without the aid of presses and the like clearly reduces their disposal cost. Alternatively, the reservoirs may be refillable, so that they can be fully reused with consequent decisive advantages in terms of environmental impact and of the associated costs.

Although the system according to the present invention is suitable for any known type of dispensing without appreciable modification, a particularly effective dispensing circuit comprises a small auxiliary recirculation chamber having an inlet element, preferably with a quick coupling to which the flexible reservoir is connectible. This auxiliary chamber has the function of a recirculation and/or reserve dye chamber and preferably has a bleeder valve which allows any small quantity of air present in the chamber when a reservoir of dye is fitted to escape almost immediately.

In a machine particularly suitable for use in a system according to the present invention, auxiliary means are provided for encouraging all of the dye to come out of the deformable reservoir. In a preferred embodiment of the machine, when the reservoir is of the type with flexible walls, pressure means, preferably, but in non-limiting manner, roller means, gradually squeeze the reservoir, starting from the top, as the volume of dye in the reservoir gradually decreases.

BRIEF DESCRIPTION OF THE DRAWINGS

The invention will now be described with reference to a preferred embodiment illustrated in the appended drawing, provided by way of non-limiting example, in which.

DETAILED DESCRIPTION OF THE INVENTION

Figure 1:
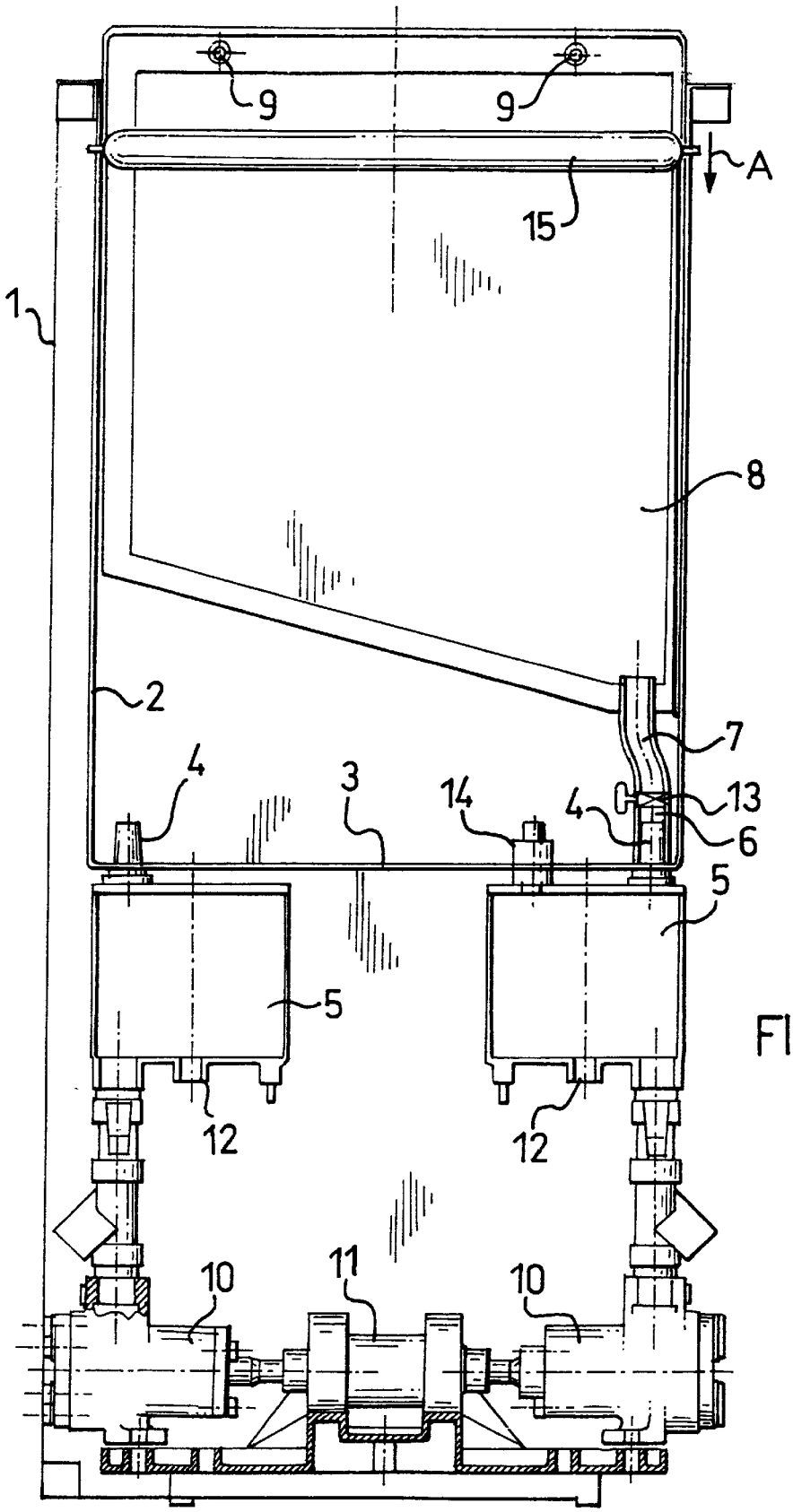
FIG. 1 shows schematically a portion of a dispensing machine having a deformable reservoir.

With reference to the drawing, the casing of a dispensing machine is indicated as 1, the machine having, in its upper portion, a tank 2 from the base 3 of which inlet elements 4 for auxiliary chambers 5 mounted below the tank 2 project. The inlet elements 4 shown in the drawing are of the simplest type with tapered coupling elements onto which the end 6 of flexible tube 7 communicating with the interior of flexible bag 8 disposed in the tank 2 and suspended on the structure of the dispensing machine by means of eyes 9, are forced. Naturally, the inlet elements may have any configuration generally known in the field of connections for rigid or flexible tubes and may also have quick coupling devices such as, for example, snap, bayonet, screwed-flange, or spring connections and the like.

The bag-suspension system may also be formed by systems other than that illustrated, for example, by means of a bar inserted in a transverse pocket formed in the top of the bag with its ends supported on opposed edges of the tank 2.

The base of the bag 8 is preferably inclined, as shown in the drawing, so as to encourage the dye contained therein to flow towards the tube 7 and hence towards one of the auxiliary chambers 5. A cut-off tap 13 is preferably mounted close to the end 6 of the tube 7. Two pressure rollers 15 disposed on opposite sides of the bag 8 and movable vertically in the direction of the arrow A, of which only the front roller is visible in the drawing, are spaced apart by a distance substantially equal to twice the thickness of the walls of the bag.

A bleeder valve 14 is disposed in an upper region of each auxiliary chamber 5 and, downstream of the auxiliary chamber 5, the dispensing circuit may be of any known configuration, for example, comprising recirculation pumps 10 driven by a motor 11 and sending the dye to a three-way valve (not shown) which selectively provides for the dye to be sent towards a dispensing head or back to the auxiliary chambers 5 through the recirculation duct 12. Further details regarding the dispensing circuit of a known dispensing machine can be obtained from the above-mentioned patent EP-0 198 856.

In the establishment producing the dyes, the last stage of the production cycle provides for the filling of the bag 8 which, for example, has an opening at the top which is subsequently sealed. Alternatively, particularly in the case of recyclable reservoirs or bags, the filling may take place through the tube 7. The interior of the closed bag contains no air so that the dye can be kept even for long periods without alteration and without drying. The transportation of the bags from the production establishment to distribution and replenishment premises is advantageously facilitated by the presence of the suspension means 9.

When the dye in a bag 8 mounted in a dispensing machine, for example, that of FIG. 1, is finished, the user releases the tube 7 from the inlet element 4 and can then fold up or package the empty bag, compressing it for subsequent disposal or for sending to the dye production establishment.

A new bag 8 full of dye is placed in the tank 2 and the tube 7 is quickly fitted on the corresponding inlet element 4. The bag is then suspended on the casing 1 of the machine. As a result of the opening of the tap 13, the weight of the dye in the bag causes it to descend into the auxiliary chamber 5 which is filled, whilst the air contained therein escapes through the bleeder valve 14. The partial and progressive emptying of the bag 8 when the dispensing machine is in operation generates a vacuum inside the bag which causes the walls to be squeezed against one another, starting from the top. The squeezing of the walls and the flow of the dye towards the bottom of the bag 8 and the tube 7 are assisted by the pressure exerted by the rollers 15 which may be driven automatically or may simply descend gradually by gravity according to the amount of dye present in the bag 8.

Naturally, the principle of the invention remaining the same, the forms of embodiment and details of construction may be varied widely with respect to those described and illustrated, without thereby departing from the scope of the present invention.

What is claimed is:

1. A dispensing machine for dispensing dye comprising support means in said machine for detachably supporting a plurality of dye filled reservoirs in said dispensing machine, each of said reservoirs having an outlet in a base thereof and valve means in said outlet to enable transporting and storing dye in said reservoirs in an air tight manner, a plurality of auxiliary chambers disposed below said reservoirs, connecting means for detachably connecting said valve means for said reservoirs to each of said auxiliary chambers respectively and dispensing circuit means connected to said auxiliary chambers wherein each auxiliary chamber has an internal volume substantially smaller than the maximum value of each of said reservoirs.

* * * * *